US007077722B2

(12) United States Patent
Mayes et al.

(10) Patent No.: US 7,077,722 B2
(45) Date of Patent: Jul. 18, 2006

(54) SYSTEMS AND METHODS FOR ACTUATING END EFFECTORS TO CONDITION POLISHING PADS USED FOR POLISHING MICROFEATURE WORKPIECES

(75) Inventors: Brett A. Mayes, Meridian, ID (US); Gunnar A. Barnhart, Idaho City, ID (US); Michael E. Meadows, Boise, ID (US); Charles K. Dringle, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 10/910,690

(22) Filed: Aug. 2, 2004

(65) Prior Publication Data

US 2006/0025054 A1 Feb. 2, 2006

(51) Int. Cl.
*B24B 1/00* (2006.01)

(52) U.S. Cl. ..... 451/21; 451/56; 451/443; 451/444; 451/285; 451/287; 451/60

(58) Field of Classification Search ..... 451/5, 451/56, 285, 287, 443
See application file for complete search history.

(56) References Cited

U.S. PATENT DOCUMENTS 4,991,353 A * 2/1991 Wiener ..... 451/11
5,616,069 A 4/1997 Walker et al.
5,626,509 A * 5/1997 Hayashi ..... 451/285
5,645,682 A 7/1997 Skrovan
5,655,951 A 8/1997 Meikle et al.
5,725,417 A 3/1998 Robinson
5,779,522 A 7/1998 Walker et al.
5,782,675 A 7/1998 Southwick
5,801,066 A 9/1998 Meikle
5,833,519 A * 11/1998 Moore ..... 451/56
5,846,336 A 12/1998 Skrovan
5,879,226 A 3/1999 Robinson
5,910,043 A 6/1999 Manzonie et al.
5,941,761 A 8/1999 Nagahara et al.
5,975,994 A 11/1999 Sandhu et al.
6,004,196 A 12/1999 Doan et al.
6,083,085 A 7/2000 Lankford
6,106,371 A 8/2000 Nagahara et al.
6,196,899 B1 3/2001 Chopra et al.
6,203,413 B1 3/2001 Skrovan
6,214,734 B1 4/2001 Bothra et al.
6,220,934 B1 4/2001 Sharples et al.
6,238,270 B1 5/2001 Robinson
6,273,800 B1 8/2001 Walker et al.
6,306,008 B1 10/2001 Moore (Continued)

*Primary Examiner*—George Nguyen
(74) *Attorney, Agent, or Firm*—Perkins Coie LLP

(57) ABSTRACT

Systems and methods for activating end effectors used to condition microfeature workpiece polishing pads are disclosed. A system in accordance with one embodiment of the invention includes a rotatable end effector having a conditioning surface configured to condition a microfeature workpiece polishing medium, and a driver coupled to the end effector to rotate the end effector. The driver does not include a flexible, continuous belt coupled to the end effector. For example, the driver can include a motor-driven worm meshed with a worm gear. The system can further include a forcing element coupled to the end effector to apply a force to the end effector that is at least approximately normal to a conditioning surface of the end effector. The forcing element can include a first generally rigid member and a second generally rigid member coupled to the end effector and movable relative to the first generally rigid member to apply the force.

22 Claims, 6 Drawing Sheets

U.S. PATENT DOCUMENTS 6,331,139 B1 12/2001 Walker et al.
6,350,691 B1 2/2002 Lankford
6,352,470 B1 3/2002 Elledge
6,354,918 B1 * 3/2002 Togawa et al. ..... 451/56
6,354,923 B1 3/2002 Lankford
6,361,411 B1 3/2002 Chopra et al.
6,361,413 B1 3/2002 Skrovan
6,368,197 B1 4/2002 Elledge
6,419,553 B1 7/2002 Koinkar et al.
6,609,962 B1 * 8/2003 Wakabayashi et al. ..... 451/443
6,648,728 B1 * 11/2003 Kojima et al. ..... 451/5
6,666,749 B1 12/2003 Taylor
6,695,680 B1 * 2/2004 Choi et al. ..... 451/5
6,769,972 B1 * 8/2004 Huang et al. ..... 451/287
6,893,336 B1 * 5/2005 Jin ..... 451/443
2004/0038534 A1 2/2004 Taylor

* cited by examiner

SYSTEMS AND METHODS FOR ACTUATING END EFFECTORS TO CONDITION POLISHING PADS USED FOR POLISHING MICROFEATURE WORKPIECES

TECHNICAL FIELD

The present invention relates generally to systems and methods for actuating end effectors for conditioning polishing pads used to polish microfeature workpieces.

BACKGROUND

Mechanical and chemical-mechanical planarization and polishing processes (collectively "CMP") remove material from the surfaces of microfeature workpieces in the production of microelectronic devices and other products. FIG. 1 schematically illustrates a rotary CMP machine 10 having a platen 22, a polishing pad 20 on the platen 22, and a carrier 30 adjacent to the polishing pad 20. The CMP machine 10 may also have an under-pad 23 between an upper surface 26 of the platen 22 and a lower surface of the polishing pad 20. A platen drive assembly 24 rotates the platen 22 (as indicated by arrow F) and/or reciprocates the platen 22 back and forth (as indicated by arrow G). Because the polishing pad 20 is attached to the under-pad 23, the polishing pad 20 moves with the platen 22 during planarization.

The carrier 30 has a carrier head 31 with a lower surface 33 to which a microfeature workpiece 12 may be attached, or the workpiece 12 may be attached to a resilient pad 32 under the lower surface 33. The carrier head 31 may be a weighted, free-floating wafer carrier, or a carrier actuator assembly 34 may be attached to the carrier head 31 to impart rotational motion to the microfeature workpiece 12 (as indicated by arrow J) and/or reciprocate the workpiece 12 back and forth (as indicated by arrow I).

The polishing pad 20 and a polishing solution 21 define a polishing medium 25 that mechanically and/or chemically-mechanically removes material from the surface of the microfeature workpiece 12. The polishing solution 21 may be a conventional CMP slurry with abrasive particles and chemicals that etch and/or oxidize the surface of the microfeature workpiece 12, or the polishing solution 21 may be a "clean" nonabrasive planarizing solution without abrasive particles. In most CMP applications, abrasive slurries with abrasive particles are used on nonabrasive polishing pads, and clean nonabrasive solutions without abrasive particles are used on fixed-abrasive polishing pads.

To planarize the microfeature workpiece 12 with the CMP machine 10, the carrier head 31 presses the workpiece 12 face-down against the polishing pad 20. More specifically, the carrier head 31 generally presses the microfeature workpiece 12 against the polishing solution 21 on a polishing surface 27 of the polishing pad 20, and the platen 22 and/or the carrier head 31 move to rub the workpiece 12 against the polishing surface 27. As the microfeature workpiece 12 rubs against the polishing surface 27, the polishing medium 25 removes material from the face of the workpiece 12.

The CMP process must consistently and accurately produce a uniformly planar surface on the microfeature workpiece 12 to enable precise fabrication of circuits and photo-patterns. One problem with existing CMP methods is that the polishing surface 27 of the polishing pad 20 can wear unevenly or become glazed with accumulations of polishing solution 21 and/or material removed from the microfeature workpiece 12 and/or the polishing pad 20. To restore the planarizing/polishing characteristics of the polishing pad 20, the pad 20 is typically conditioned by removing the accumulations of waste matter with a conditioner 40. Such conditioners are available from Applied Materials of Santa Clara, Calif. under the trade name Mirra.

The existing conditioner 40 typically includes an abrasive end effector 41 having a head 45 generally embedded with diamond particles. The head 45 is attached to a single shaft 42 which connects to a shaft housing 72. The shaft housing 72 is supported relative to the polishing pad 20 by an arm 43 and a support housing 44. A motor 51 within the support housing 44 rotates the shaft housing 72, the shaft 42 and the head 45 (as indicated by arrow A) via a pair of pulleys 53*a*, 53*b* and a connecting belt 54. The conditioner 40 can also include a separate actuator (not shown in FIG. 1) that sweeps the arm 43 and the end effector 41 back and forth (as indicated by arrow B). A bladder 71 rotates with the shafts 42 and applies a normal force to the head 45 (as indicated by arrow C) to press the head 45 against the polishing pad 20. In another arrangement (available from Ebara Corporation of Tokyo, Japan), a non-rotating air cylinder counteracts the dead weight of the head 45 to regulate the down-force applied against the polishing pad 20. In either arrangement, the typical end effector 41 removes a thin layer of the polishing pad material in addition to the waste matter to form a new, clean polishing surface 27 on the polishing pad 20.

One drawback associated with the arrangements described above with reference to FIG. 1 is that the drive belt 54 typically wears out at a relatively rapid rate. Accordingly, the operator of the CMP machine 10 must spend a significant amount of time replacing the belt 54, which reduces the throughput of the machine 10. Furthermore, as the belt 54 wears and fails, it can contaminate the polishing pad 20 with debris, which can interfere not only with the conditioning operation but also with the polishing operations conducted on the polishing pad 20. Still further, when the machine 10 is operated in an autonomous manner, the belt 54 can fail without an automatic provision for halting the sweeping action of the arm 43. As a result, the head 45 can sweep back and forth without rotating, which can condition the polishing pad in an uneven manner and/or create an uneven wear pattern on the abrasive surface of the head 45.

Another drawback associated with the system described above with reference to FIG. 1 is that the bladder 71 (used to apply a normal force to the head 45) can fail after a relatively short duty cycle, further increasing the amount of time and money required to keep the machine 10 operational. Still further, the operator must often over-pressure the bladder 71 to overcome a threshold inflation resistance, and then reduce the pressure to apply the desired force. This can result in inconsistent down-forces applied to the polishing pad 20, which can in turn lead to inconsistent polishing pad conditions, and ultimately, inconsistent surface conditions on the workpiece 12.

DETAILED DESCRIPTION

Figure 1:
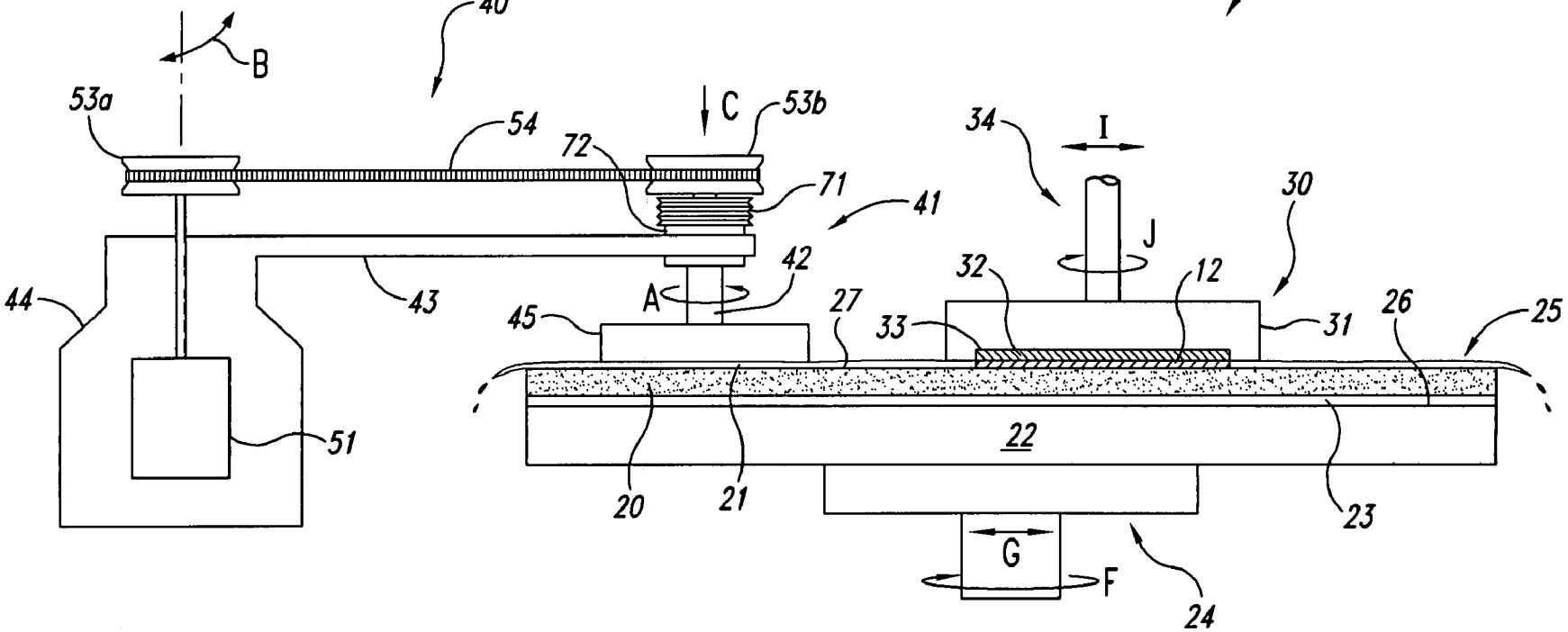
Fig. 1 (Prior Art)
FIG. 1 is a partially schematic, side elevation view of a CMP system having a conditioner arranged in accordance with the, prior art.

The present invention is directed toward systems and methods for actuating end effectors used to condition polishing pads that are in turn used to polish microfeature workpieces. A system in accordance with one aspect of the invention includes a rotatable end effector having a conditioning surface configured to condition a microfeature workpiece polishing medium, and a driver coupled to the end effector to rotate the end effector. The driver does not include a flexible, continuous belt coupled to the end effector. For example, the driver can instead include a first gear (e.g., a worm) coupled to a motor, and engaged with a second gear (e.g., a worm gear) coupled to the end effector. In other embodiments, the driver can include a rotatable impeller in fluid communication with a conduit that is coupleable to a source of high pressure fluid. In still a further embodiment, the drive link can include a drive chain coupled between the end effector and a motor.

A system in accordance with another aspect of the invention can include a rotatable end effector having a conditioning surface configured to condition a microfeature workpiece polishing medium, a driver coupled to the end effector to rotate the end effector, and a forcing element coupled to the end effector. The forcing element can include a first generally rigid member and a second generally rigid member. The second generally rigid member can be coupled to the end effector, and can be operatively coupled to the first generally rigid member. At least one of the members can be movable relative to the other to apply a force to the end effector that is at least approximately normal to the conditioning surface. At least one of the members can also rotate with the end effector. In a particular aspect of the invention, at least one of the first and second generally rigid members includes a cylinder and the other includes a piston received in the cylinder and slidable along a motion axis relative to the cylinder.

The invention is also directed toward methods for making and using systems for conditioning microfeature workpiece polishing pads. In one aspect of the invention, a method for retrofitting a system having features for conditioning microfeature workpiece polishing media includes removing a flexible, continuous belt coupled between an end effector and a motor, wherein the end effector has a conditioning surface configured to condition a microfeature workpiece polishing medium. The method can further include coupling a driver to the end effector to rotate the end effector, wherein the driver does not include a flexible, continuous belt coupled to the end effector. For example, the method can include connecting a first gear to the motor, connecting a second gear to the end effector, and coupling the first gear to the second gear without a flexible, continuous belt.

A method for operating a system having features for conditioning microfeature workpiece polishing media can include contacting a conditioning surface of an end effector with a polishing medium and applying an at least approximately normal force to the polishing medium with the conditioning surface by moving at least one generally rigid member of a forcing mechanism coupled to the end effector relative to a second generally rigid element of the forcing mechanism. The method can further include rotating the end effector and at least one of the generally rigid members together relative to the polishing medium.

As used herein, the terms "microfeature workpiece" and "workpiece" refer to substrates on and/or in which microelectronic devices are integrally formed. Typical microdevices include microelectronic circuits or components, thin-film recording heads, data storage elements, microfluidic devices, and other products. Micromachines and micromechanical devices are included within this definition because they are manufactured using much of the same technology that is used in the fabrication of integrated circuits. The substrates can be semiconductive pieces (e.g., doped silicon wafers or gallium arsenide wafers), nonconductive pieces (e.g., various ceramic substrates) or conductive pieces. In some cases, the workpieces are generally round, and in other cases the workpieces have other shapes, including rectilinear shapes. Several embodiments of systems and methods for conditioning polishing media are described below. A person skilled in the relevant art will understand, however, that the invention may have additional embodiments, and that the invention may be practiced without several of the details of the embodiments described below with reference to FIGS. 2–8.

Figure 2:
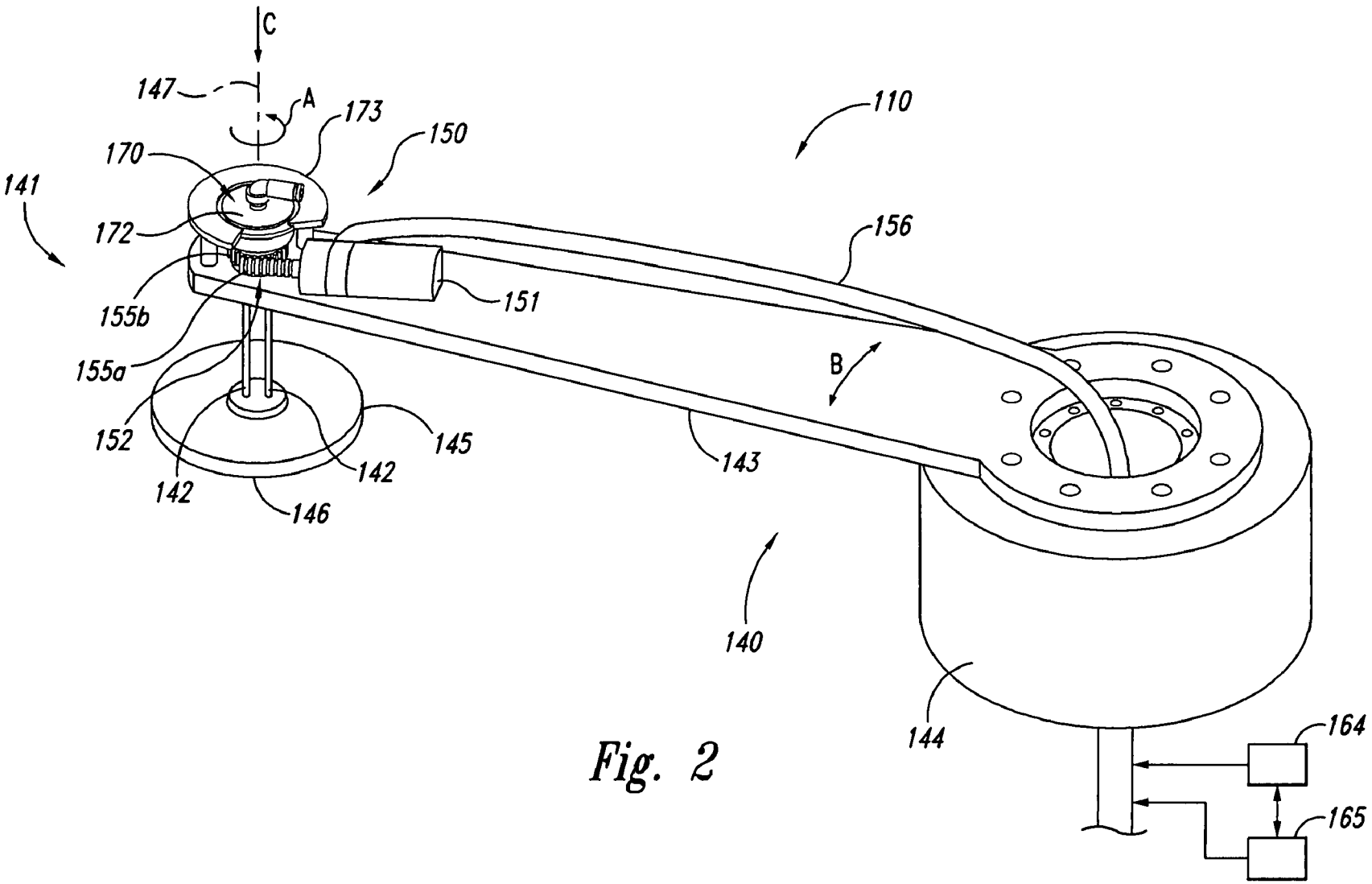
FIG. 2 is a partially schematic, isometric illustration of a CMP system having a conditioner that is actuated in accordance with an embodiment of the invention.

FIG. 2 is a partially schematic, isometric illustration of a CMP system 110 having a conditioner 140 that is activated in accordance with an embodiment of the invention. The conditioner 140 can include a support housing 144, an arm 143 extending outwardly from the support housing 144, and an end effector 141 carried by the arm 143. The end effector 141 can be rotated by a driver 150 that does not include a belt coupled to the end effector 141. Accordingly, embodiments of the conditioner 140 can condition microfeature workpiece polishing pads without some or all of the drawbacks described above with reference to FIG. 1. Further details of these embodiments are described below.

The end effector 141 can include a conditioning head 145 having a conditioning surface 146. The conditioning surface 146 can have abrasive elements (e.g., diamond particles) that rub against a polishing pad during operation. The conditioning head 145 can be coupled to two shafts 142 extending into a housing 172. A forcing device 170 positioned within the housing 172 can apply a normal force to the conditioning head 145 via the shafts 142 (as indicated by arrow C), along an actuation axis 147. A housing carriage 173 can support the housing 172 relative to the arm 143. Further details of the forcing device 170 are described below with reference to FIG. 7.

The housing 172 and the end effector 141 can also rotate about the actuation axis 147 (as indicated by arrow A) when the driver 150 is activated. Accordingly, the driver 150 can include a motor 151 coupled to the end effector 141 with a drive link 152. In a particular embodiment shown in FIG. 2, the drive link 152 can include a first gear 155*a* (e.g., a worm)

engaged with a second gear 155*b* (e.g., a worm gear or ring gear) carried by the housing 172. A signal link 156 (e.g., a cable bundle) provides power and control signals to the motor 151 to direct the rotational motion of the end effector 141.

One feature of an embodiment of the CMP system 110 shown in FIG. 2 is that the drive link 152 does not include a continuous, flexible belt coupled between the motor 151 and the end effector 141. An advantage of this feature is that the system 110 may operate for longer periods of time than existing systems before the drive link 152 requires maintenance. For example, the gears 155*a*, 155*b* can be manufactured from wear-resistant metals and/or plastics to significantly increase the expected life span of these components. A further advantage of this feature is that the wear resistant gears 155*a*, 155*b* (and, optionally, other components of the drive link 152) are less likely to shed particles during use and are accordingly less likely to interfere with either pad conditioning operations or workpiece polishing operations.

Still another feature of an embodiment of system 110 shown in FIG. 2 is that the drive link 152 can be retrofitted onto existing systems (e.g., the system 10 described above with reference to FIG. 1) with relatively little effort. For example, the housing carriage 173 can be partially cut away (as shown in FIG. 2) and the pulley originally carried by the housing 172 can be replaced with the second gear 155*b*. The motor 151 can be the same motor as the motor 51 shown in FIG. 1, simply repositioned and coupled to the first gear 155*a*, then mounted to the arm 143 to provide a more direct coupling with the end effector 141. In a particular embodiment, the motor 151 and associated motor controller are available from Yaskawa Motors of Tokyo, Japan. In a particular aspect of this embodiment, the gear reduction box normally provided with such motors can be eliminated because the gears 155*a*, 155*b* provide sufficient gear reduction (e.g., 20:1). An advantage of this feature is that it can significantly reduce the time and cost associated with retrofitting existing systems with a drive link that does not include a flexible belt.

In one embodiment, the system 110 shown in FIG. 2 can include a detector 164 coupled to the motor 151 to detect a change in the electrical energy drawn by the motor 151. The system 110 can also include a controller 165 operatively coupled to the detector 164 and the motor 151 to control the operation of the motor 151 based on signals received from the detector 164. For example, the detector 164 can detect a change in the current and/or power drawn by the motor, and the controller 165 can halt the motor when the change differs from a threshold value by more than a selected amount. In a particular embodiment, a reduction in current drawn by the motor 151 can indicate that the drive link 152 has failed. This operation can occur regardless of the nature of the drive link 152. Accordingly, this aspect of the system 110 can be applied to drive links generally similar to those described above the reference to FIG. 1, as well as those described with reference to FIGS. 2–8.

In another aspect of this embodiment, the change in the electrical energy drawn by the motor 151 can correspond to a condition other than a failure of the drive link 152. For example, such a change can correspond to a failure of the forcing device 170. In a particular embodiment, a reduction of current drawn by the motor 151 can correspond to an abnormal reduction in the downforce applied by the forcing device 170. In any of the foregoing embodiments, the system 110 can signal the operator to indicate a failure or abnormal condition, and/or can automatically halt motion of the end effector 141. The end effector motor can include rotation about the actuation axis 147 (as indicated by arrow A), and/or a sweeping motion of the arm 143 (as indicated by arrow B).

In still another aspect of this embodiment, the change in the electrical energy drawn by the motor 151 can correspond to a change in the condition of the polishing pad being conditioned by the conditioner 140. For example, the amount of texture at the surface of the polishing pad can be an important factor in determining whether or not the polishing pad has been adequately conditioned. Because it typically requires more power to move the end effector 141 over a rough polishing pad than over a smooth polishing pad, the amount of power drawn by the motor 151 can indicate whether the polishing pad has been sufficiently roughened by the conditioning operation.

Figure 3:
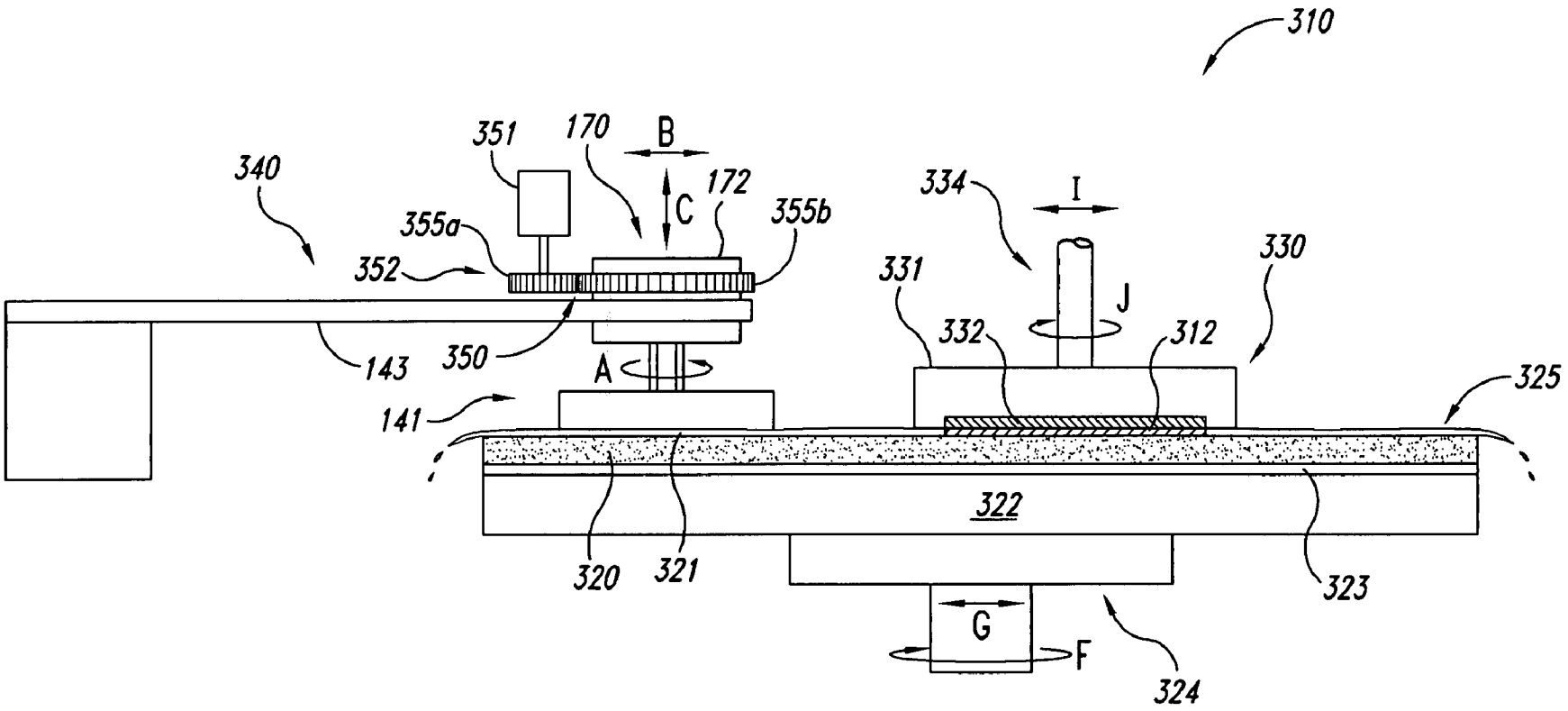
FIG. 3 illustrates a system having a motor coupled to an end effector in accordance with another embodiment of the invention.

FIGS. 3–6 illustrate CMP systems having drive links configured in accordance with further embodiments of the invention. Referring first to FIG. 3, a system 310 can include a conditioner 340 positioned proximate to a polishing pad 320. The polishing pad 320 can be supported by a platen 322 or other support, optionally with an underpad 323 positioned between the platen 322 and the polishing pad 320. A drive assembly 324 can rotate the platen 322 and the polishing pad 320 (as indicated by arrow F) and translate the platen 322 and the polishing pad 320 (as indicated by arrow G). A polishing liquid 321 can be disposed on the polishing pad 320, and the polishing pad 320 (with or without the polishing liquid 321) can form a polishing medium 325 for removing material from a microfeature workpiece 312.

A microfeature workpiece 312 can be supported relative to the polishing pad 320 with a carrier 330. Accordingly, the carrier 330 can include a carrier head 331 and, optionally, a resilient pad 332 that supports the workpiece 312 relative to the polishing pad 320. The carrier 330 can include a carrier actuator assembly 334 that translates the carrier head 331 and the workpiece 312 (as indicated by arrow I) and/or rotates the carrier head 331 and the workpiece 312 (as indicated by arrow J). The relative movement between the polishing pad 320 and the workpiece 312 chemically and/or chemically-mechanically removes material from the surface of the workpiece 312 during polishing and/or planarization.

The conditioner 340 can condition the polishing pad 320 before, after, and/or during the polishing operation. The conditioner 340 can include a drive link 350 that, like the drive link 150 described above with reference to FIG. 2, does not include a continuous flexible belt. Instead, the drive link 350 can include a first gear 355*a* carried by a motor 351 and meshed with a second gear 355*b* carried by the housing 172. In this particular embodiment, the gears 355*a*, 355*b* can include straight-cut or helical-cut gears, and the axis of rotation of the first gear 355*a* can be parallel to the axis of rotation of the second gear 355*b*. An advantage of this arrangement is that it may be suitable for motors 351 that do not require a significant gear reduction to drive the end effector 141. Conversely, an advantage of the arrangement described above with reference to FIG. 2 is that the worm 155*a* and worm gear 155*b* can provide a significant gear reduction for a high-speed motor 151.

Figure 4:
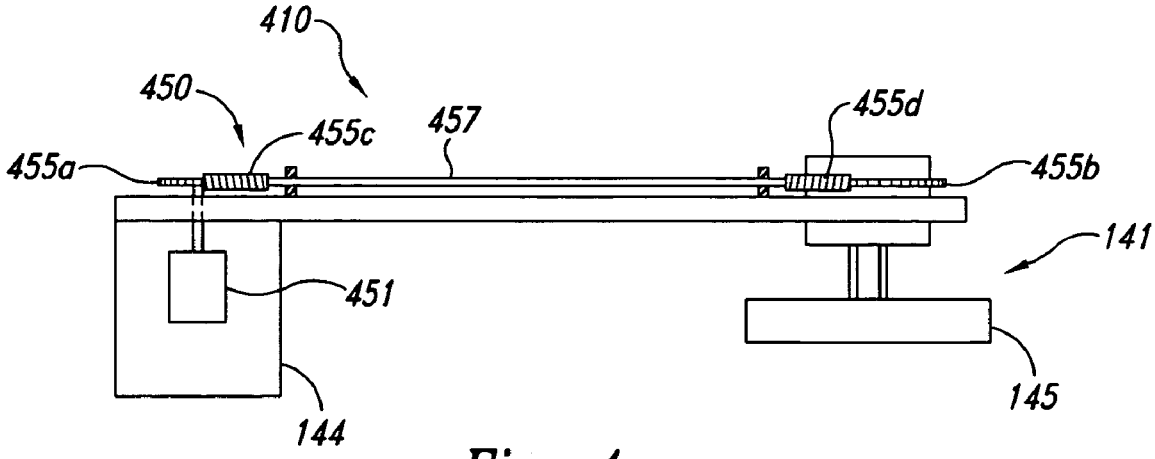
FIG. 4 illustrates a system having a drive shaft coupled between an end effector and a motor in accordance with still another embodiment of the invention.

FIG. 4 is a partially schematic illustration of a CMP system 410 having a drive link 450 that rotates the end effector 141 in accordance with another embodiment of the invention. In one aspect of this embodiment, the drive link 450 can include a motor 451 positioned in the support housing 144 to rotate a first gear 455*a*. The end effector 141 can include a second gear 455*b*, and a drive shaft 457 can transmit rotary motion between the first gear 455*a* and the second gear 455*b*. Accordingly, the drive shaft 457 can carry a third gear 455*c* meshed with the first gear 455*a*, and a fourth gear 455*d* meshed with the second gear 455*b*. The third and fourth gears 455*c*, 455*d* can include worms (as shown in FIG. 4) or other gear arrangements (e.g., bevel gears).

Figure 5:
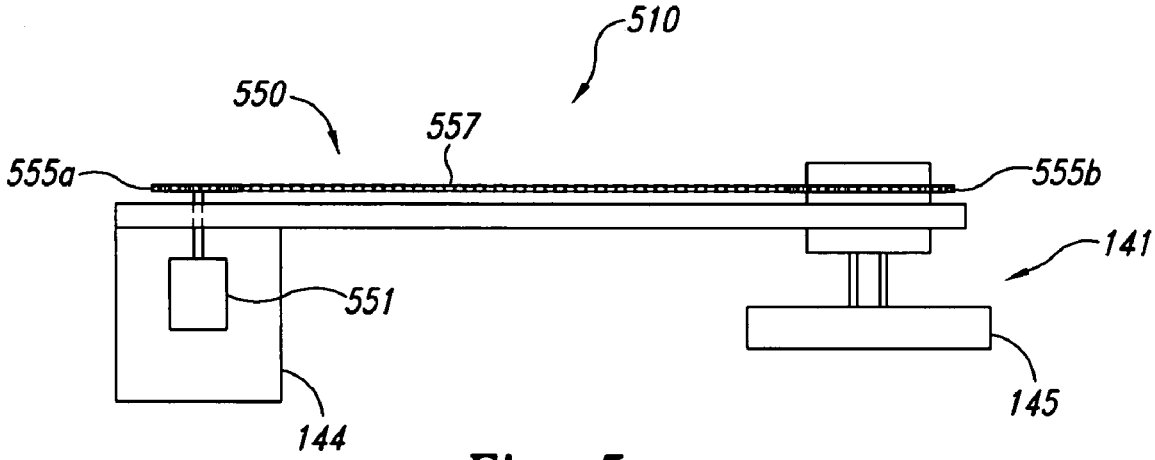
FIG. 5 illustrates a system having a chain coupled between an end effector and a motor in accordance with yet another embodiment of the invention.

FIG. 5 illustrates a CMP system 510 having a drive link 550 configured in accordance with yet another embodiment of the invention. In this embodiment, the drive link 550 includes a motor 551 carried in the support housing 144 and connected to a first sprocket 555*a*. A second sprocket 555*b* is carried by the end effector 141, and is driven by the first sprocket 555*a* via a chain 557. The chain 557 can include multiple, generally rigid segments that are pivotably connected to each other. Accordingly, the motor 551 can drive the end effector 141 without the drawbacks associated with the flexible continuous belt shown in FIG. 1.

In still further embodiments, at least a portion of the drive link powering the end effector can include a fluid coupling. For example, referring now to FIG. 6A, a system 610 in accordance with another embodiment of the invention can include a drive link 650*a* that provides a fluid (e.g., hydraulic or pneumatic) driving force. Accordingly, the end effector 141 can include an impeller 658 positioned within an impeller channel or housing 659 and coupled to the shafts 142. A fluid conduit 660 having a nozzle 661 directs high pressure fluid to the impeller 658 to rotate the impeller 658 and the conditioning head 145. Fluid can be supplied to the fluid conduit 660 from a high pressure fluid supply 663, and can be controlled with a valve 662. The fluid can be returned to the high pressure fluid supply 663 via a return line and pump (not shown in FIG. 6A), for example, when the fluid includes a liquid. The fluid can be exhausted to the atmosphere (or optionally recycled) when the fluid includes air or another suitable gas.

Figure 6A:
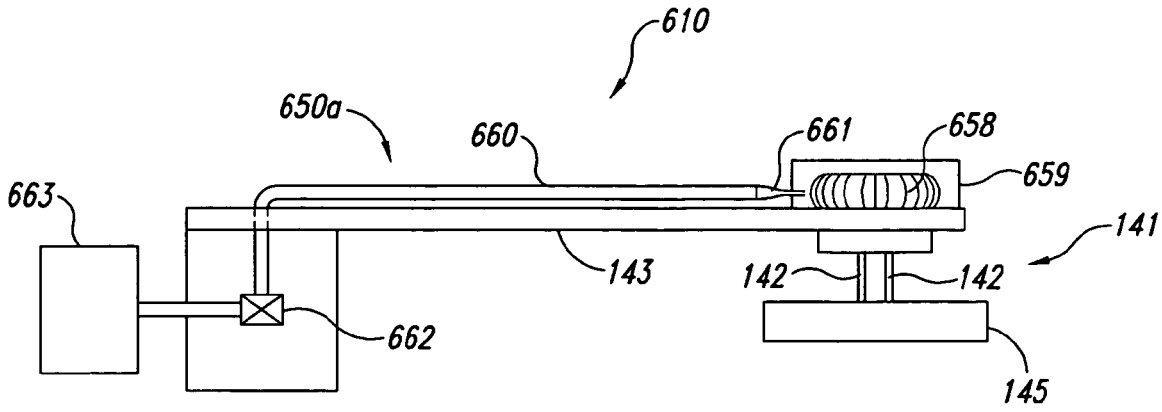
FIG. 6A illustrates a system having an end effector rotatably driven by an impeller in accordance with still a further embodiment of the invention.
Figure 6B:
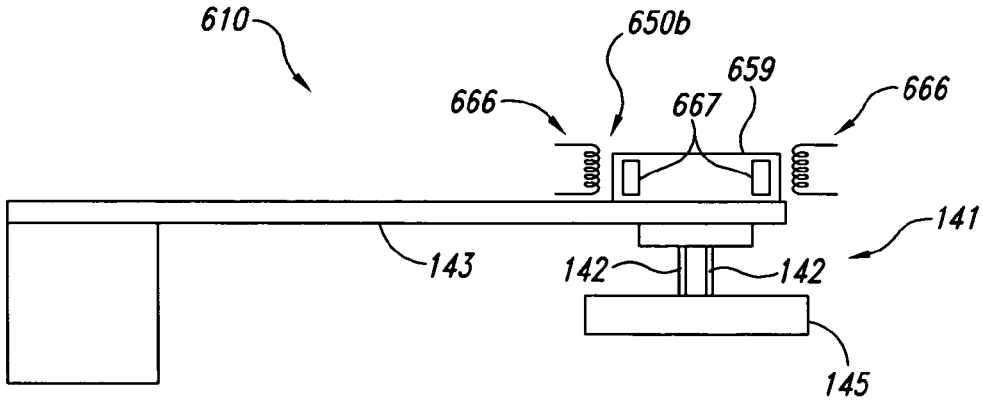
FIG. 6B illustrates a system having an end effector rotatably driven by a motor in accordance with yet another embodiment of the invention.

FIG. 6B illustrates another embodiment of the system 610 having another arrangement for rotating the conditioning head 145. In one aspect of this embodiment, the system 610 can include a drive link 650*b* that in turn includes one or more fixed members 666 (e.g., electrical coils) that depend from the arm 143, and one or more rotating members 667 (e.g., magnets) that depend from the rotating housing 659. When a current is applied to the fixed members 666, it induces a current in the rotating members 667 to rotatably drive the conditioning head 145. The first and second members 666, 667 can be integrated into a motor, for example, a direct drive motor, including a Megatorque motor, available from NSK Ltd., of Tokyo, Japan.

One feature of the foregoing arrangement is that it can eliminate gears, pulleys, belts, chains and other mechanical drive elements. An advantage of this feature is that it can be simpler to install and maintain, and can be less likely to generate particulates, which can contaminate the polishing pad 320 (FIG. 3). Another advantage of this feature is that it can reduce the noise associated with mechanical drive elements, which might otherwise have adverse effects on feedback signals, including those used to determine the status of the polishing pad 320, the drive link 650*b* and/or the microfeature workpiece 312 (FIG. 3) processed by the system 610.

Figure 7:
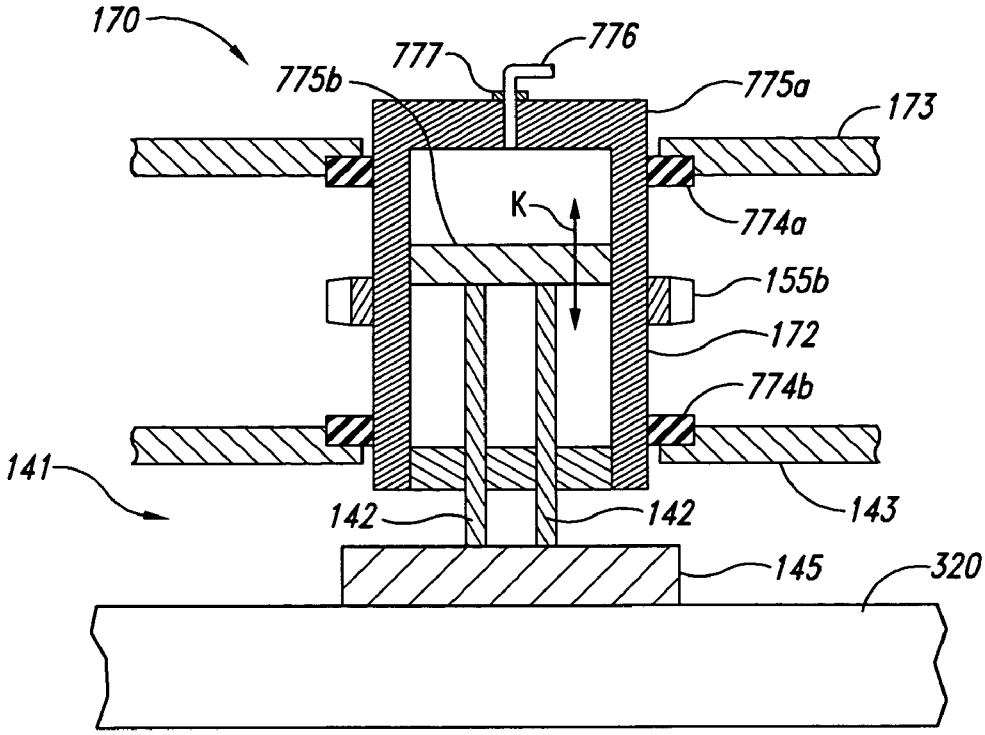
FIG. 7 illustrates a portion of a system having a piston and cylinder arrangement for applying a normal force to an end effector in accordance with an embodiment of the invention.
Figure 8:
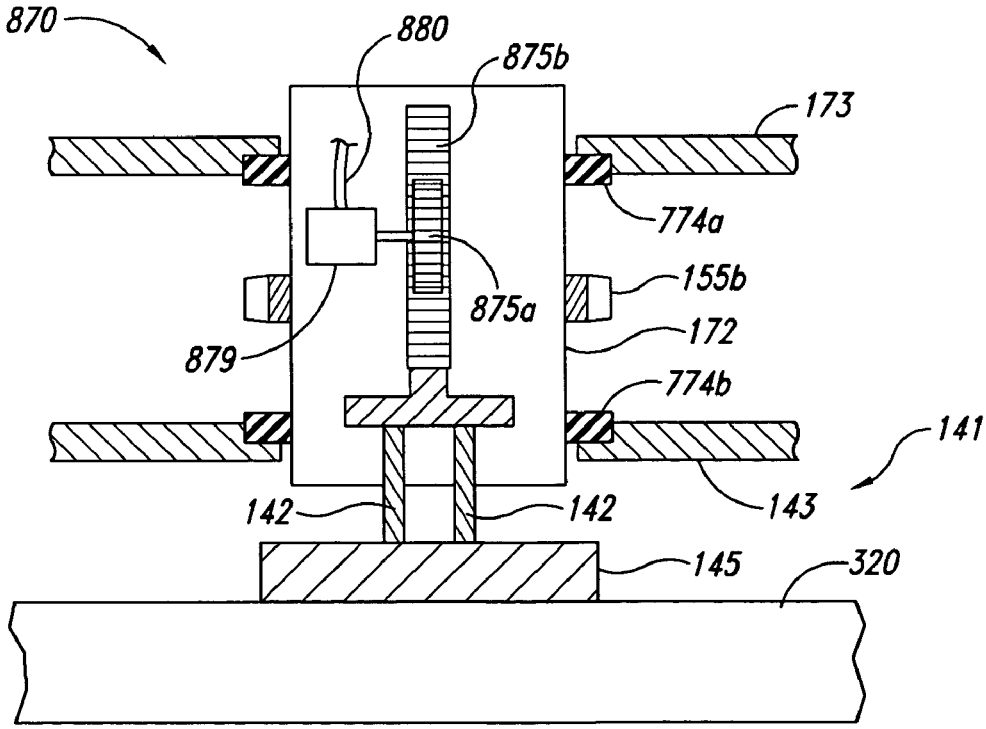
FIG. 8 illustrates a system having a rack and pinion arrangement for applying a normal force to an end effector in accordance with still another embodiment of the invention.

FIGS. 7 and 8 illustrate further details of the forcing element 170 identified above with reference to FIG. 2 in accordance with further embodiments of the invention. As shown in FIG. 7, the forcing element 170 can include the housing 172 supported by the arm 143 and the housing carriage 173. Upper and lower bearings 774*a* and 774*b* allow the housing 172 to rotate smoothly relative to the arm 143 and the housing carriage 173. The forcing element 170 can further include a first generally rigid member 775*a* and a second generally rigid member 775*b* that is operatively coupled to the first generally rigid member 775*a*. At least one of the members 775*a*, 775*b* is movable relative to the other to impart an at least approximately normal force to the conditioning head 145. For example, in an embodiment shown in FIG. 7, the first member 775*a* can include a cylinder, and the second member 775*b* can include a piston that is axially movable within the cylinder (as indicated by arrow K) and is coupled to the shafts 142 of the end effector 141. One (or as shown in FIG. 7, both) of the members 775*a*, 775*b* can rotate with the conditioning head 145.

In a particular aspect of this embodiment, the first rigid member 775*a* can include a cylinder coupled a fluid supply line 776 that is in turn selectively coupleable to a vacuum source and a pressure source. When pressure is provided to the cylinder the down-force applied to the conditioning head 145 increases, and when a vacuum is applied to the cylinder, the down-force decreases. A swivel joint 777 allows the forcing element 170 to rotate relative to the fluid supply line 776.

In other embodiments, the relative positions of the first member 775*a* and the second member 775*b* can be altered. For example, the relative positions can be inverted so that the cylinder is coupled to the conditioning head 145 and moves axially relative to the piston to apply a force to the conditioning head 145. In other embodiments, the force applied to the conditioning head 145 can be regulated with other actuator mechanisms having first and second generally rigid members. For example, referring now to FIG. 8, a forcing device 870 in accordance with another embodiment of the invention can include a motor 879 connected to a first rigid member 875*a* (e.g., a gear or pinion). The first rigid member 875*a* can in turn engage a second rigid member 875*b* (e.g., a rack) which is in turn coupled to the conditioning head 145. When power is supplied to the motor 879 via leads, the motor 879 can be directed to rotate clockwise or counterclockwise to increase or decrease the pressure applied to the conditioning head 145. In other embodiments, the forcing device 870 can have other arrangements that also apply an at least approximately normal force to the conditioning head 145.

One feature of embodiments of the forcing devices described above with reference to FIGS. 7 and 8 is that they do not include a bladder or other flexible, inflatable device to control the pressure applied to the conditioning head 145. Instead, they include a generally rigid members operatively coupled to each other and movable relative to each other. An advantage of this arrangement is that the first and second generally rigid members can provide a more predictable, repeatable force to the conditioning head 145. As a result, the manner in which the conditioning head 145 conditions the polishing pad can be more easily repeated, which can produce more uniform polishing pad surfaces and accordingly, more uniform surfaces on the workpieces that are engaged with the polishing pad.

Another advantage of the foregoing features is that the generally rigid components may be less likely to fail than the flexible bladder described above with reference to FIG. 1. As a result, the time and effort required to service and maintain the apparatus can be significantly reduced, which can in turn reduce the cost of processing the microfeature workpieces.

From the foregoing, it will be appreciated that specific embodiments of the invention have been described herein for purposes of illustration, but that various modifications may be made without deviating from the spirit and scope of the invention. For example, features described in the context of a particular embodiment of the invention can be combined or eliminated in other embodiments. Any of the systems described above with reference to FIGS. 2 and 4–8 can include a polishing pad, workpiece carrier and associated drive assemblies, generally similar to those described above with reference to FIG. 3. Accordingly, the invention is not limited except as by the appended claims.

We claim:

1. A system including features for conditioning microfeature workpiece polishing media, the system comprising:

a rotatable end effector having a conditioning surface configured to condition a microfeature workpiece polishing medium, wherein the end effector includes a first shaft and a first pear carried by the first shaft; and a motor having a second shaft and a second gear carried by the second shaft and directly engaged with the first gear.

2. The system of claim 1, further comprising a forcing device coupled to the end effector, the forcing device including a first generally rigid member and a second generally rigid member, the second generally rigid member being coupled to the end effector and being movable relative to the first generally rigid member, and the first generally rigid member being movable relative to the second generally rigid member, to apply a force to the end effector that is at least approximately normal to the conditioning surface.

3. The system of claim 1, further comprising the polishing medium, and wherein the polishing medium includes polishing pad material.

4. The system of claim 1, further comprising:

a support;

the polishing medium, and wherein the polishing medium includes polishing pad material carried by the support;

a workpiece carrier positioned at least proximate to the polishing medium, the workpiece carrier being configured to releasably carry a microfeature workpiece; and an actuator coupled to at least one of the support and the workpiece carrier to move the at least one of the support and the workpiece carrier relative to the other.

5. A system including features for conditioning microfeature workpiece polishing media, the system comprising:

an end effector having a head coupled to a first shaft, the head having a conditioning surface configured to condition a microfeature workpiece polishing medium;

a motor having a second shaft positioned at least proximate to the first shaft; and a drive link coupled between the first and the second shaft to rotate the end effector, wherein the drive link includes a first gear element attached to the first shaftand a second gear element attached to the second shaft, and wherein the first gear element is meshed with the second gear element.

6. The system of claim 5 wherein the first gear element includes a worm and wherein the second gear element includes a worm gear engaged with the worm.

7. The system of claim 5 wherein the first gear is meshed with the second gear.

8. The system of claim 5, further comprising:

a support;

the polishing medium, and wherein the polishing medium includes polishing pad material carried by the support;

a workpiece carrier positioned at least proximate to the polishing medium, the workpiece carrier being configured to releasably carry a microfeature workpiece; and an actuator coupled to at least one of the support and the workpiece carrier to move the at least one of the support and the workpiece carrier relative to the other.

9. A system including features for conditioning polishing media for polishing microfeature workpieces, the system comprising:

a rotatable end effector having a conditioning surface configured to condition a microfeature workpiece polishing medium, wherein the end effector includes a first shaft carrying a first gear;

a motor, having a second shaft carrying a second gear; wherein the second gear is directly engaged with the first gear; and a forcing device coupled to the end effector, the forcing device including a first generally rigid member and a second generally rigid member operatively coupled to the first generally rigid member, the second generally rigid member being coupled to the end effector and being movable relative to the first generally rigid member, and first generally rigid member being movable relative to the second generally rigid member, to apply a force to the end effector that is at least approximately normal to the conditioning surface, at least one of the generally rigid members being rotatable with the end effector.

10. The system of claim 9 wherein one of the first and second generally rigid members includes a cylinder and wherein the other of the first and second generally rigid members includes a piston received in the cylinder, the piston being slideable relative to the cylinder along a motion axis.

11. The system of claim 9, further comprising:

a support;

the polishing medium, and wherein the polishing medium includes polishing pad material carried by the support;

a workpiece carrier positioned at least proximate to the polishing medium, the workpiece carrier being configured to releasably carry a microfeature workpiece; and an actuator coupled to at least one of the support and the workpiece carrier to move the at least one of the support and the workpiece carrier relative to the other.

12. A system including features for conditioning polishing media for polishing microfeature workpieces, the system comprising:

rotatable conditioning means for conditioning a microfeature workpiece polishing medium, wherein the rotatable conditioning means includes a first shaft and a first gear carried by the first shaft; and drive means for rotating the conditioning means, the drive means being coupled to the conditioning means, wherein the drive means does not include a flexible, continuous belt coupled to the conditioning means and wherein the drive means includes an electric motor having a second shaft and a second gear carried by the second shaft, the second gear being directly engaged with the first gear.

13. The system of claim 12 wherein the conditioning means includes an end effector having a conditioning surface configured to contact the microfeature workpiece polishing medium.

14. The system of claim 12, wherein the conditioning means includes a head having a conditioning surface, wherein the system further comprises a forcing device coupled to the conditioning means, the forcing device including a first generally rigid member and a second generally rigid member operatively coupled to the first generally rigid member, the second generally rigid member being coupled to the conditioning means and being movable relative to the first generally rigid member, and the first generally rigid member being movable relative to the second generally rigid member, to apply a force to the conditioning means that is at least approximately normal to the conditioning surface, at least one of the generally rigid members being rotatable with the conditioning means.

15. The system of claim 12 wherein the drive means includes a rotatable impeller coupled to the conditioning means, the drive means further including a conduit in fluid communication with the impeller and coupleable to a source of high pressure fluid.

16. The system of claim 12, further comprising the polishing medium, and wherein the polishing medium includes polishing pad material.

17. The system of claim 12, further comprising:

a support;

the polishing medium, and wherein the polishing medium includes polishing pad material carried by the support;

a workpiece carrier positioned at least proximate to the polishing medium, the workpiece carrier being configured to releasably carry a microfeature workpiece; and an actuator coupled to at least one of the support and the workpiece carrier to move the at least one of the support and the workpiece carrier relative to the other.

18. A system including features for conditioning microfeature workpiece polishing media, the system comprising:

a rotatable end effector rotatable around a first rotation axis and having a conditioning surface configured to condition a microfeature workpiece polishing medium;

a rotatable arm rotatable around a second rotation axis proximate to a first end of the rotatable arm and carrying the rotatable end effector proximate to a second end of the rotatable arm; and a driver coupled to the end effector to rotate the end effector, the driver including:

an electric motor carried by the rotatable arm, the motor having a shaft that is not parallel with either the first or the second rotation axis; and a drive link coupled between the motor and the end effector.

19. A method for manufacturing a system having features for conditioning microfeature workpiece polishing media, the method comprising:

providing a rotatable end effector having a conditioning surface configured to condition a microfeature workpiece polishing medium, wherein the end effector includes a first shaft and a first gear attached to the first shaft; and coupling a motor having a second shaft carrying a second gear to the end effector to rotate the end effector by engaging the second gear directly with the first gear.

20. The method of claim 19 wherein the first gear includes a worm gear and the second gear includes a worm and wherein the method further comprises:

coupling a forcing device to the end effector by coupling a piston of the forcing device to the end effector, the piston being received in and movable relative to a cylinder to apply a force to the end effector that is at least approximately normal to the conditioning surface.

21. The method of claim 19 wherein coupling a motor driver includes:

attaching a worm to a motor;

attaching a worm gear to the end effector; and engaging the worm gear with the worm.

22. The method of claim 19, further comprising:

positioning the end effector at least proximate to a support for a polishing medium;

positioning a workpiece carrier at least proximate to the support, the workpiece carrier being configured to releasably carry a microfeature workpiece; and coupling an actuator to at least one of the support and the workpiece carrier to move the at least one of the support and the workpiece carrier relative to the other.

* * * * *

UNITED STATES PATENT AND TRADEMARK OFFICE

CERTIFICATE OF CORRECTION

PATENT NO. : 7,077,722 B2
APPLICATION NO. : 10/910690
DATED : July 18, 2006
INVENTOR(S) : Mayes et al.

It is certified that error appears in the above-identified patent and that said Letters Patent is hereby corrected as shown below:

Column 9
Line 14, “pear” should be --gear--;
Line 50, “shaftand” should be --shaft and--;

Signed and Sealed this

Thirteenth Day of February, 2007

JON W. DUDAS
*Director of the United States Patent and Trademark Office*